US006397760B1

(12) United States Patent
Schmidt

(10) Patent No.: US 6,397,760 B1
(45) Date of Patent: Jun. 4, 2002

(54) DEVICE FOR TRANSMITTING THE LONGITUDINAL FORCES OF A BOGIE TO THE SUPERSTRUCTURE OF A RAIL VEHICLE, IN PARTICULAR A MOTOR VEHICLE WITH HIGH TRACTIVE POWER

(75) Inventor: Gerhard Schmidt, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/623,960

(22) PCT Filed: Mar. 9, 1999

(86) PCT No.: PCT/DE99/00682

§ 371 (c)(1),
(2), (4) Date: Nov. 9, 2000

(87) PCT Pub. No.: WO99/46155

PCT Pub. Date: Sep. 16, 1999

(30) Foreign Application Priority Data

Mar. 12, 1998 (DE) ..... 198 10 697

(51) Int. Cl.[7] ..... B61F 5/38
(52) U.S. Cl. ..... 105/199.1; 105/168
(58) Field of Search ..... 105/199.1, 199.2, 105/176, 164, 165, 168, 171; 74/579 R

(56) References Cited

U.S. PATENT DOCUMENTS 3,433,177 A * 3/1969 Cripe ..... 105/199.1
3,547,046 A * 12/1970 Lich ..... 105/199.1
3,974,779 A * 8/1976 Lindblom et al. ..... 105/164
4,233,910 A * 11/1980 Schumacher ..... 105/168
4,982,671 A * 1/1991 Chollet et al. ..... 105/168
5,335,602 A * 8/1994 Richter et al. ..... 105/168
5,638,757 A * 6/1997 Cortesi ..... 105/168
5,690,034 A * 11/1997 Schahl et al. ..... 105/199.1

FOREIGN PATENT DOCUMENTS

| | | | |
|---|---|---|---|
| CH | 415 726 | | 1/1967 |
| CH | 415726 | * | 1/1967 |
| DE | 12 24 768 | | 9/1966 |
| DE | 1224768 | * | 9/1966 |

* cited by examiner

*Primary Examiner*—S. Joseph Morano
*Assistant Examiner*—Lars A. Olson
(74) *Attorney, Agent, or Firm*—Young & Thompson

(57) ABSTRACT

A device for transmitting the longitudinal forces of a bogie to the superstructure of a rail vehicle, in particular a motor vehicle with high tractive power. The device includes a transmission rod arranged in the longitudinal direction of the vehicle and comprising two rod parts (4), of which one rod part engages on a pivot point of the superstructure and the other rod part engages on a pivot point of the bogie frame. The two rod parts are connected at a joint which is capable of rotary motion about the transverse axis of the vehicle and is supported vertically relative to the bogie frame. The two rod parts and the joint capable of rotary motion are embodied in a buckle-resistant manner, the joint being connected to the bogie frame in a manner which allows force to be transmitted in both vertical directions.

7 Claims, 2 Drawing Sheets

SO
L
L1
L2
h
β
1
2
3
4
5
6
7
8
9
10
11

DEVICE FOR TRANSMITTING THE LONGITUDINAL FORCES OF A BOGIE TO THE SUPERSTRUCTURE OF A RAIL VEHICLE, IN PARTICULAR A MOTOR VEHICLE WITH HIGH TRACTIVE POWER

FIELD OF THE INVENTION

The invention relates to a device for transmitting the longitudinal forces of a bogie to the superstructure of a rail vehicle, in particular a motor vehicle with high tractive power. A transmission rod is arranged in the longitudinal direction of the vehicle. The transmission rod includes two rod parts. One rod part engages on a pivot point of the superstructure. The other rod part engages on a pivot point of the bogie frame. The two rod parts are connected at a joint which is capable of rotary motion about the transverse axis of the vehicle and is supported vertically relative to the bogie frame.

BACKGROUND INFORMATION

In German Patent No. DE-B 12 24 768, two transmission rods are provided, whose respective joint capable of rotary motion is supported in a vertically upward direction relative to an associated rolling surface on the bogie by means of taper rollers. The two transmission rods can each transmit forces to the superstructure only in one direction of load; thus, when tractive and braking forces occur, either one or the other transmission rod is effective, depending on the direction of travel. The duplication of transmission rods and the corresponding need to duplicate the pivot points both on the superstructure and on the bogie are regarded as disadvantageous.

SUMMARY

An object of the present invention is to provide a device of the generic type in such a way, by means that are a device with which longitudinal forces which occur can be transmitted in the direction of tension and in the direction of compression with just one transmission rod.

According to an example embodiment of the present invention, this object is achieved by virtue of the fact that the two rod parts and the joint capable of rotary motion are embodied in a buckle-resistant manner, the joint being connected to the bogie frame in a manner which allows force to be transmitted in th vertical directions.:

DESCRIPTION

Figures 1, 2:
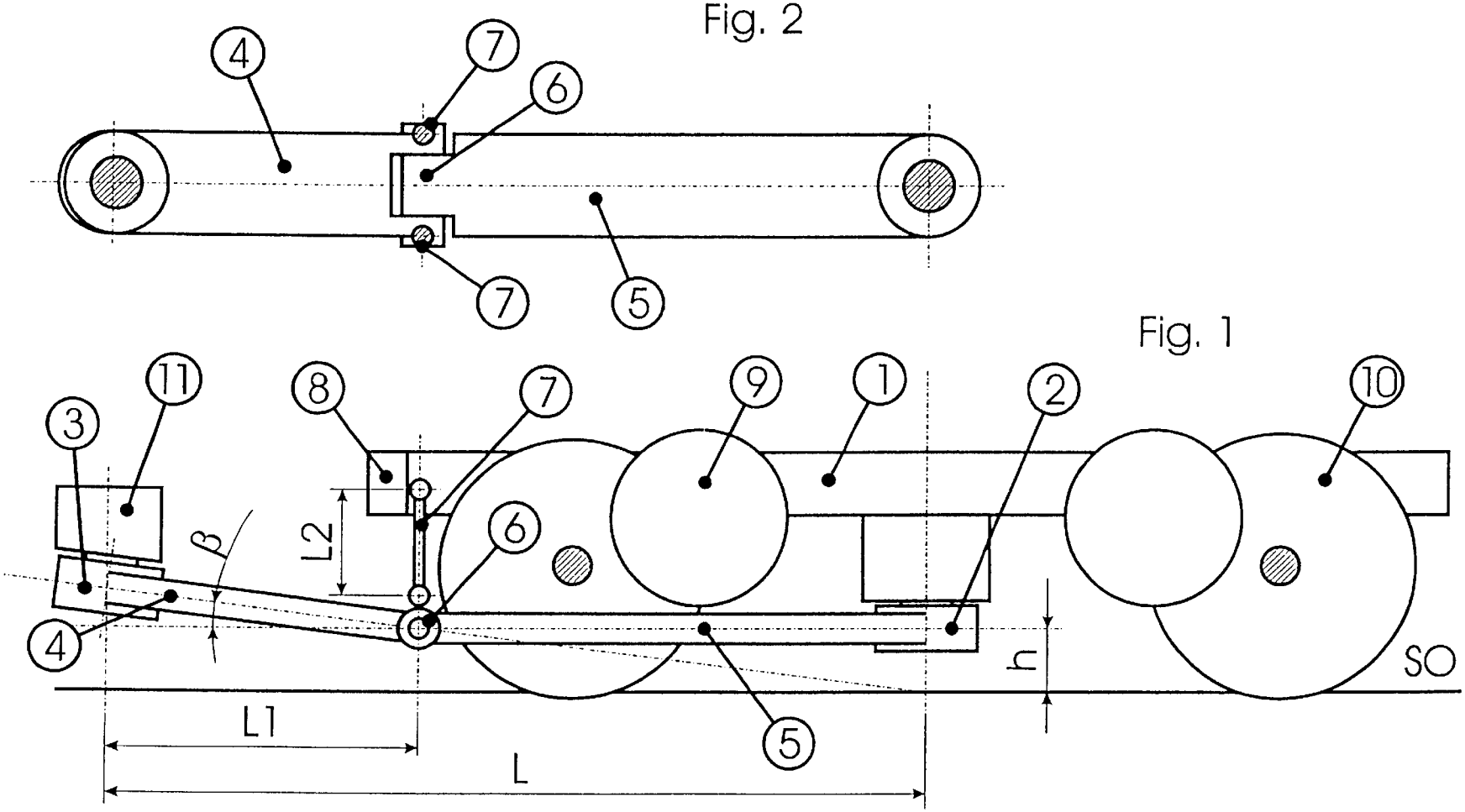
FIG. 1 shows a power bogie and a superstructure of a rail vehicle with a device for transmitting longitudinal forces in side view.
FIG. 2 shows components of the device for transmitting longitudinal forces in accordance with FIG. 1 in plan view.

The power bogie has a bogie frame 1, wheel sets 10 driven by traction motors 9, and braking equipment, which can comprise disk brakes and rail brakes.

Transmission of longitudinal forces is performed by a transmission rod formed by two rod parts 4 and 5, these rod parts 4 and 5 being connected at a joint 6 capable of rotation about the transverse axis of the vehicle. The first rod part 4 engages on a pivot point 3 of the superstructure 11; the second rod part 5 is attached at a pivot point 2 of the bogie frame 1 which is at a relatively small vertical distance h from the top rail edge SO.

With a view to transmission of longitudinal forces both in the direction of tension and in the direction of compression, the rod parts 4 and 5 of the transmission rod and the rotatable joint 6, which is preferably designed as a wide hinge joint, are embodied in a buckle-resistant manner, the joint 6 being connected to the bogie frame 1 in a force-transmitting manner in both vertical directions. According to the exemplary embodiments, this force-transmitting connection is formed by a linkage mechanism, which has two pendulum-type links 7 which are parallel in the initial state and which are connected to the joint 6 and to the headstock 8 of the bogie frame 1. By means of this connection, the buckling length is furthermore advantageously limited to the respective rod part 4 or 5.

The pivoted connection according to the present invention allows all movements between the bogie and the superstructure, namely turning out about the vertical axis, galloping, transverse translation, pitching and rolling, apart from movements in the longitudinal direction, in which of course force transmission is to take place. The transmission rod has different total lengths and pivot points during these various types of relative motion:

For motion in the plane of horizontal projection (horizontal), that is to say turning out about the vertical axis and transverse translation, the joint 6 connects the two parts 4 and 5 of the transmission rod rigidly; the transmission rod has the effective length L between the pivot points 2 and 3.

For motion in the plane of vertical projection (vertical), that is to say galloping and pitching, the transmission rod can move in the joint 6, which is attached rigidly to the bogie frame 1 in the perpendicular plane as described. The transmission rod effectively comprises only its part 4 of length L1 between the pivot point 3 and the joint 6 capable of rotary motion.

Rolling movements are absorbed by cardan-type movements about the pivot point 3 on the superstructure 11.

By inclining the first part 4 of the transmission rod at the angle ββ, it is possible to ensure that the line of action of the longitudinal forces intersects the center of the bogie at the level of the top rail edge SO. Since the second rod part 5 does not have any vertical mobility relative to the bogie frame 1, drive components such as, in this case, the traction motors 9, can be arranged in the immediate vicinity of this rod part 5. Moreover, with a view to achieving the maximum possible free installation space for the drive components, the rod part 5, in particular, is made flat, i.e., its overall height is significantly less than the overall width (taking into account the required buckling stiffness).

Figure 4:
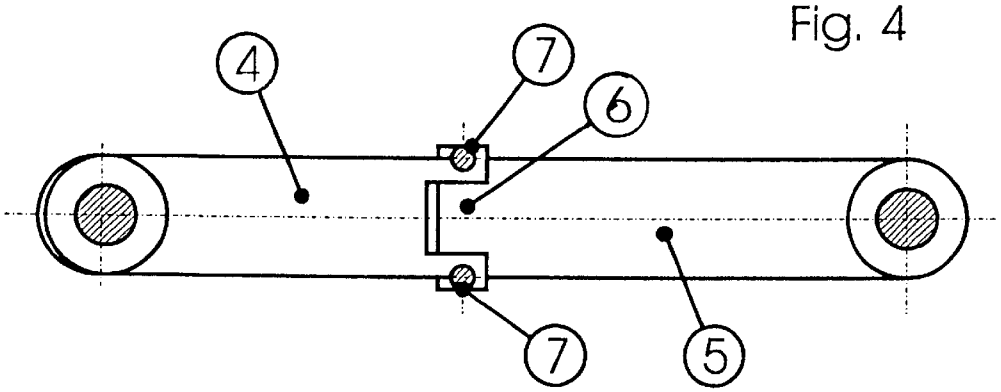
FIG. 4 shows a plan view that complements FIG. 3, in a view corresponding to FIG. 2.
Figure 3:
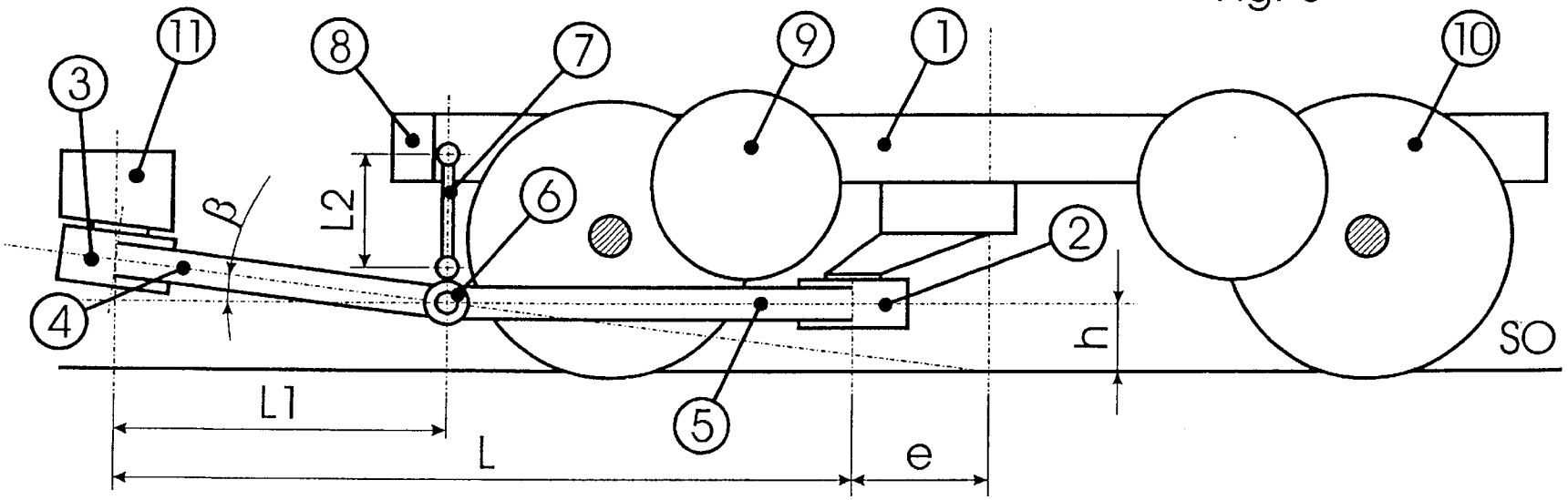
FIG. 3 shows an embodiment which has been modified compared with that in FIG. 1, likewise in side view.

In the exemplary embodiment shown in FIGS. 3 and 4, the pivot point 2 of the rod part 5 on the bogie is offset in the longitudinal direction out of the transverse center of the bogie by a distance e toward the joint 6 capable of rotary motion.

The effects of this offset on the turn-out force of the bogie largely compensate the effects due to the guidance of the joint 6 because the joint 6 does not move laterally in a plane but on a spherical surface with the radius L2 owing to the two parallel pendulum-like links 7.

| List of reference numerals | |
|---|---|
| 1 | Bogie frame |
| 2 | Pivot point on the bogie frame |
| 3 | Pivot point on the superstructure |
| 4 | First part of a transmission rod |
| 5 | Second part of a transmission rod |
| 6 | Joint capable of rotary motion (hinge joint) |
| 7 | Pendulum-like links as part of a linkage mechanism |
| 8 | Headstock of the bogie frame |
| 9 | Traction motor |
| 10 | Wheel set |
| 11 | Superstructure |
| L | Effective length of the transmission rod 4, 5 between the pivot points 2 and 3 |
| L 1 | Effective length of the transmission rod - here only part 4 - between the pivot point 3 and the joint 6 |
| L2 | Radius of the lateral mobility of the bogie frame on a spherical surface |
| SO | Top rail edge |
| h | Vertical distance between the pivot point 2 on the bogie and the top rail edge |
| e | Distance by which the pivot point 2 on the bogie is offset in the longitudinal direction out of the center of the bogie toward the joint 6 |
| ββ | Angle of inclination of the first part 4 of the transmission rod |

What is claimed is:

1. A device for transmitting longitudinal forces of a bogie to a superstructure of a rail vehicle, comprising:

a transmission rod arranged in a longitudinal direction of the vehicle, the transmission rod including two rod parts, a first one of the rod parts configured to engage on a pivot point of the superstructure, a second one of the rod parts configured to engage on a pivot point of a frame of the bogie, the rod parts being connected to each other at a joint, the joint being configured for rotary motion about a traverse axis of the vehicle and being supported vertically relative to the frame of the bogie, the rod parts being embodied in a buckle-resistance manner, the joint being connected to the frame of the bogie in a manner which allows force to be transmitted in both vertical directions.

2. The device according to claim 1, wherein the rail vehicle is a motor vehicle with high tractive power.

3. The device according to claim 1, wherein the joint is configured as a hinge joint.

4. The device according to claim 1, wherein the joint is connected to the frame of the bogie using a linkage mechanism to allow the force to be transmitted in both vertical directions.

5. The device according to claim 4, wherein the linkage mechanism includes two pendulum-like links which are parallel to each other in an initial state and which are connected to the joint and to a headstock of the frame of the bogie.

6. The device according to claim 1, wherein the first one of the rod parts is arranged obliquely in a vertical plane.

7. A device for transmitting longitudinal forces of a bogie to a superstructure of a rail vehicle, comprising:

a transmission rod arranged in a longitudinal direction of the vehicle, the transmission rod including two rod parts, a first one of the rod parts configured to engage on a pivot point of the superstructure, a second one of the rod parts configured to engage on a pivot point of a frame of the bogie, the rod parts being connected to each other at a joint, the joint being configured for rotary motion about a traverse axis of the vehicle and being supported vertically relative to the frame of the bogie, the rod parts being embodied in a buckle-resistance manner, the joint being connected to the frame of the bogie in a manner which allows force to be transmitted in both vertical directions, wherein the first one of the rod parts is arranged obliquely in a vertical plane, and the pivot point of the second one of the rod parts on the bogie is offset in a longitudinal direction out of a transverse center of the bogie by a distance toward the joint, the offset compensating for effects on a turn-out force of the bogie due to guidance of the joint.

* * * * *